US009728138B2

(12) United States Patent
Kim

(10) Patent No.: US 9,728,138 B2
(45) Date of Patent: Aug. 8, 2017

(54) ORGANIC LIGHT EMITTING DISPLAY DEVICE AND METHOD OF DRIVING THE SAME

(71) Applicant: LG DISPLAY CO., LTD., Seoul (KR)

(72) Inventor: Seung Tae Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/301,030

(22) Filed: Jun. 10, 2014

(65) Prior Publication Data

US 2015/0002502 A1 Jan. 1, 2015

(30) Foreign Application Priority Data

Jun. 28, 2013 (KR) ..... 10-2013-0075736

(51) Int. Cl.
*G09G 5/00* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2320/029* (2013.01); *G09G 2320/043* (2013.01); *G09G 2320/0693* (2013.01); *G09G 2330/021* (2013.01); *G09G 2360/16* (2013.01)

(58) Field of Classification Search
CPC ..... G09G 2320/029; G09G 2320/043; G09G 2320/0693; G09G 2330/021; G09G 2360/16; G09G 3/3233; G09G 3/3291
See application file for complete search history.

(56) References Cited

U.S. PATENT DOCUMENTS 7,362,322 B2 * 4/2008 Kimura ..... H05B 33/08 345/211
7,868,857 B2 * 1/2011 Nathan ..... G09G 3/3241 345/690
2003/0063081 A1 * 4/2003 Kimura ..... G09G 3/3233 345/211
2006/0012311 A1 1/2006 Ogawa
2006/0061292 A1 3/2006 Koh et al.
(Continued)

FOREIGN PATENT DOCUMENTS

CN 101079233 A 11/2007
CN 102074189 A 5/2011

*Primary Examiner* — Michael J Jansen, II
(74) *Attorney, Agent, or Firm* — Birch, Stewart, Kolasch & Birch, LLP

(57) ABSTRACT

Discussed is an organic light emitting display device. The organic light emitting display device includes a display panel configured to include a plurality of pixels that each include an OLED and a pixel circuit for emitting light from the OLED, a compensation circuit configured to generate an initial compensation voltage of a driving TFT and a sequential compensation voltage based on an elapse of a driving time of the driving TFT, a data driver configured to reflect the compensation voltage in a data voltage based on an image signal to generate a driving voltage that is used to drive the driving TFT included in the pixel circuit, and supply the driving voltage of the driving TFT to each of the plurality of pixels, and a timing controller configured to set a driving voltage of the data driver, based on a sequential compensation voltage at a current time.

10 Claims, 9 Drawing Sheets

(56) References Cited

U.S. PATENT DOCUMENTS

| | | | | |
|---|---|---|---|---|
| 2006/0273997 | A1* | 12/2006 | Nathan | G09G 3/3241 345/78 |
| 2008/0174574 | A1 | 7/2008 | Yoo | |
| 2008/0284679 | A1* | 11/2008 | Ishizuka | G09G 3/3233 345/55 |
| 2010/0277513 | A1 | 11/2010 | Byun | |
| 2011/0084992 | A1* | 4/2011 | Ishizuka | G09G 3/3233 345/690 |
| 2011/0122119 | A1 | 5/2011 | Bae et al. | |
| 2011/0199395 | A1 | 8/2011 | Nathan et al. | |
| 2013/0286055 | A1* | 10/2013 | Nathan | G09G 3/3241 345/690 |

* cited by examiner

ORGANIC LIGHT EMITTING DISPLAY DEVICE AND METHOD OF DRIVING THE SAME

CROSS-REFERENCE TO RELATED APPLICATIONS

This application claims the priority benefit of the Korean Patent Application No. 10-2013-0075736 filed on Jun. 28, 2013, which is hereby incorporated by reference as if fully set forth herein.

BACKGROUND

Field of the Invention

The present invention relates to an organic light emitting display device, and more particularly, to an organic light emitting display device and a method of driving the same, which optimize a driving voltage of a data driver to reduce power consumption.

Discussion of the Related Art

General organic light emitting display devices include a display panel, which includes a plurality of pixels respectively formed in a plurality of pixel areas defined by intersections between a plurality of data lines and a plurality of gate lines, and a panel driver that emits light from the plurality of pixels.

A compensation scheme is categorized into an internal compensation scheme and an external compensation scheme depending on a position of a circuit that compensates for a characteristic deviation of pixels. The internal compensation scheme is a scheme in which a compensation circuit for compensating for a characteristic deviation of pixels is disposed inside each of the pixels. The external compensation scheme is a scheme in which the compensation circuit for compensating for a characteristic deviation of pixels is disposed outside each pixel.

FIG. 1 is a circuit diagram for describing a pixel structure based on an internal compensation scheme of a related art organic light emitting display device.

Referring to FIG. 1, each of a plurality of pixels formed in a display panel includes a switching thin film transistor (TFT) ST1, a driving TFT DT, a capacitor Cst, an organic light emitting diode OLED, and a compensation circuit that compensates for a change in a characteristic (a threshold voltage and mobility) of the driving TFT.

The first switching TFT ST1 is turned on according to a gate driving signal (a scan signal) supplied to a corresponding gate line GL. The first switching TFT ST1 is turned on, and thus, a data voltage Vdata supplied to a corresponding data line DL is supplied to the driving TFT DT.

The driving TFT DT is turned on with the data voltage Vdata supplied to the first switching TFT ST1. A data current Ioled flowing to the organic light emitting diode OLED is controlled with a switching time of the driving TFT DT. A driving voltage EVDD is supplied to a power line PL, and when the driving TFT DT is turned on, the data current Ioled is applied to the organic light emitting diode OLED.

The capacitor Cst is connected between a gate and source of the driving TFT DT. The capacitor Cst stores a voltage corresponding to the data voltage Vdata supplied to the gate of the driving TFT DT.

The organic light emitting diode OLED is electrically connected between the source of the driving TFT DT and a cathode voltage EVSS. The organic light emitting diode OLED emits light with the data current Ioled supplied from the driving TFT DT.

However, the threshold voltage (Vth) and mobility characteristics of the driving TFTs DT of the respective pixels are differently shown due to a non-uniformity of a TFT manufacturing process. For this reason, in general organic light emitting display devices, despite that the same data voltage Vdata is applied to the driving TFTs DT of the respective pixels, since a deviation of currents flowing in the respective organic light emitting diodes OLED occurs, it is unable to realize a uniform image quality.

To solve such problems, a compensation circuit is provided in each pixel. The compensation circuit senses the changes in a threshold voltage "Vth" and mobility "k" of the driving TFT of each pixel, and compensates for the changes in the threshold voltage "Vth" and mobility "k". Therefore, a driving voltage "Vdata+Vth" that is obtained by summating a compensation voltage "Vth" and a data voltage Vdata based on an image signal is supplied to a gate of the driving TFT.

The related art organic light emitting display device controls a level of the data current Ioled, which flows from a first driving voltage EVDD terminal to the organic light emitting diode OLED, by using a switching time of the driving TFT DT. Therefore, the organic light emitting diode OLED of each pixel emits light, thereby displaying an image.

FIGS. 2 and 3 are diagrams illustrating a related art SVDD voltage setting method based on the external compensation scheme.

Referring to FIGS. 2 and 3, a driving voltage supplied to a driving TFT is obtained by summating a compensation voltage and a data voltage Vdata based on an image signal. The compensation voltage "initial compensation voltage+sequential compensation voltage" is obtained by summating an initial compensation voltage, used to compensate for an initial deviation, and a sequential compensation voltage which is used to compensate for a sequential change such as deterioration or a characteristic change during a use period. An SVDD value that is a driving voltage of a data driver is determined according to the maximum value of a driving voltage supplied to the driving TFT. An initial compensation region and a sequential compensation region is not clearly divided in a compensation voltage, and a voltage range obtained by subtracting an initial compensation voltage range from a total compensation voltage range is used as the sequential compensation voltage.

In a related art organic light emitting display device based on the internal compensation scheme, the sum of the compensation voltage "Vth" (generated by the compensation circuit of a pixel) and a data voltage Vdata input to the pixel is applied to the driving TFT. In the internal compensation scheme in which the compensation circuit is provided in each pixel, the compensation voltage is added in each pixel, and thus, the same driving voltage is applied irrespective of the threshold voltage and the mobility.

As illustrated in FIG. 2, the SVDD voltage that is the driving voltage of the data driver is set to a fixed value irrespective of the compensation voltage "Vth". Since the SVDD voltage is fixed and used, the voltage remaining for sequential compensation in the compensation voltage is not actually used, and the SVDD voltage is set as a high voltage, thereby wasting power. For example, when it is assumed that the data voltage Vdata is 10 V, the compensation voltage is 8 V, the initial compensation voltage is 2 V, and the SVDD voltage is 18 V, only a voltage of 12 V is initially used in the SVDD voltage of 18 V. That is, a voltage of 6 V is consumed without being used.

Moreover, as illustrated in FIG. 3, the SVDD voltage is changed according to an average picture level (APL) of the data voltage Vdata. In this case, the SVDD value is changed by reacting on a change in the data voltage Vdata with respect to the maximum compensation voltage, irrespective of the threshold voltage "Vth" and the mobility "k". Therefore, as the APL becomes higher, a ratio of an unused compensation voltage in a total SVDD voltage increases, and thus, consumption power that is wasted without being actually used increases.

SUMMARY

Accordingly, the present invention is directed to providing an organic light emitting display device and a method of driving the same that substantially obviate one or more problems due to limitations and disadvantages of the related art.

An aspect of the present invention is directed to providing an organic light emitting display device with a reduced driving voltage and a method of driving the same.

Another aspect of the present invention is directed to providing an organic light emitting display device and a method of driving the same, which can decrease consumption power that is wasted without being actually used in a driving voltage (SVDD) of a data driver.

Another aspect of the present invention is directed to providing an organic light emitting display device and a method of driving the same, which can increase an accuracy and stability of characteristic (a threshold voltage/mobility) compensation of a driving TFT.

Another aspect of the present invention is directed to provide an organic light emitting display device and a method of driving the same, which can decrease a real-time compensation error of characteristic (a threshold voltage/mobility) compensation of a driving TFT.

In addition to the aforesaid objects of the present invention, other features and advantages of the present invention will be described below, but will be clearly understood by those skilled in the art from descriptions below.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device including: a display panel configured to include a plurality of pixels that each include an organic light emitting diode (OLED) and a pixel circuit for emitting light from the OLED; a compensation circuit configured to generate an initial compensation voltage of a driving thin film transistor (TFT) and a sequential compensation voltage based on an elapse of a driving time of the driving TFT; a data driver configured to reflect the compensation voltage in a data voltage based on an image signal to generate a driving voltage that is used to drive the driving TFT included in the pixel circuit, and supply the driving voltage of the driving TFT to each of the plurality of pixels; and a timing controller configured to set a driving voltage of the data driver, based on a sequential compensation voltage at a current time.

In another aspect of the present invention, there is provided a method of driving an organic light emitting display device including: in setting a driving voltage of a data driver for generating a pixel driving voltage that is a sum of a data voltage based on an image signal, an initial compensation voltage of a driving thin film transistor (TFT) of a pixel, and a sequential compensation voltage based on an elapse of a driving time of the driving TFT, extracting a compensation voltage of each of all pixels at a current time to calculate a maximum compensation voltage; and setting the driving voltage of the data driver, based on a sum of the data voltage based on the image signal and the maximum compensation voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Figure 1:
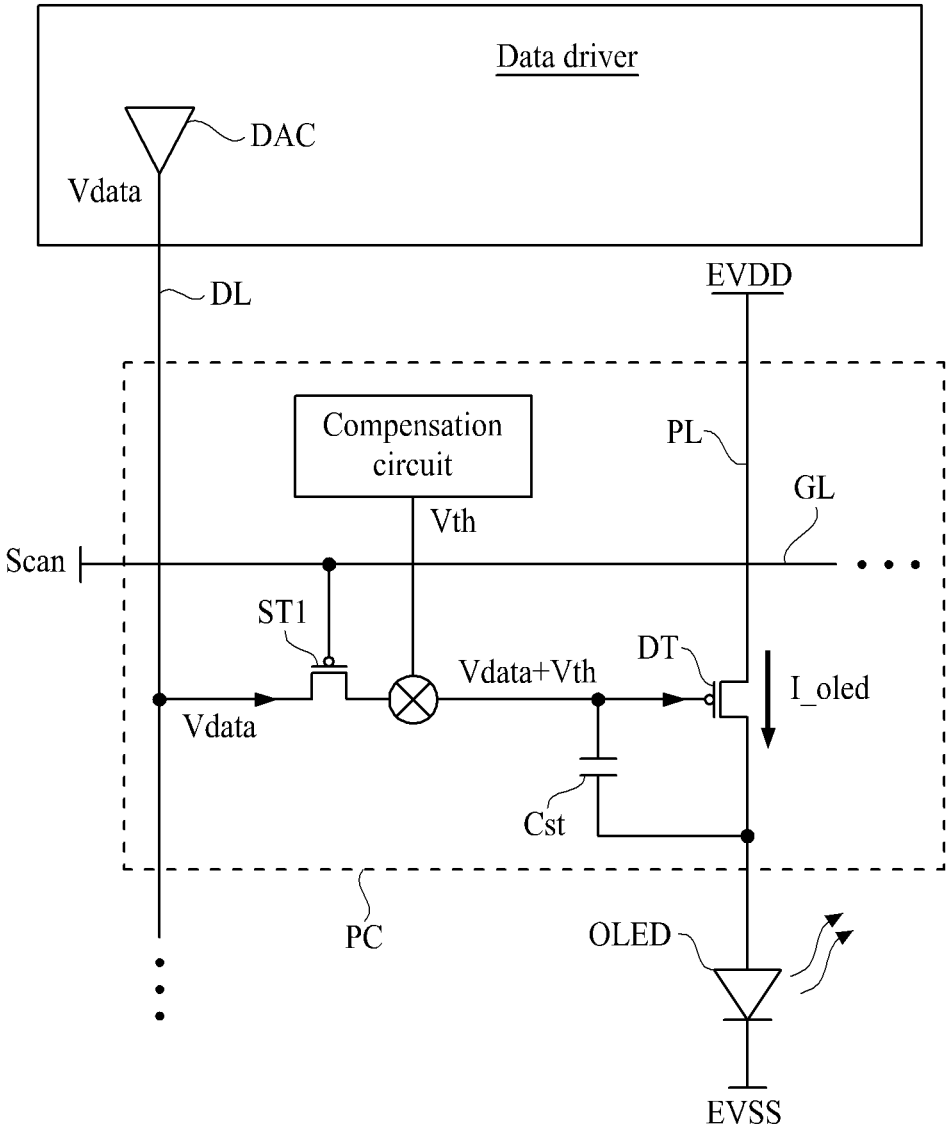
FIG. 1 Related Art
FIG. 1 is a circuit diagram for describing a pixel structure based on an internal compensation scheme of a related art organic light emitting display device.
Figure 2:
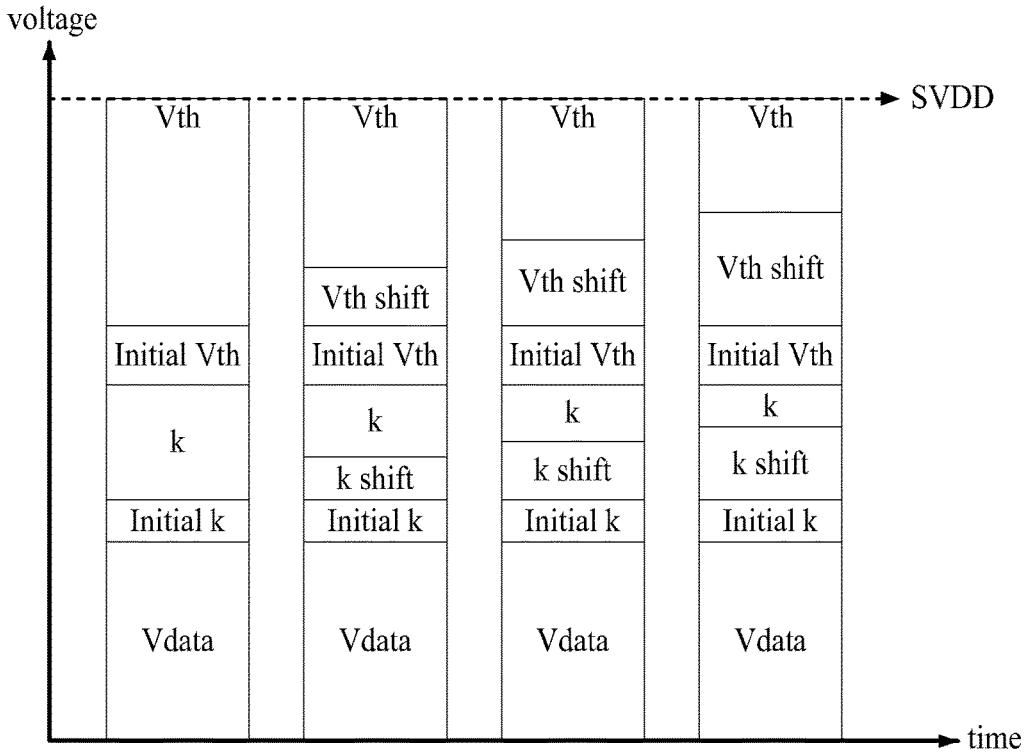
FIG. 2 Related Art
FIGS. 2 and 3 are diagrams illustrating a related art SVDD voltage setting method based on the external compensation scheme.
Figure 3:
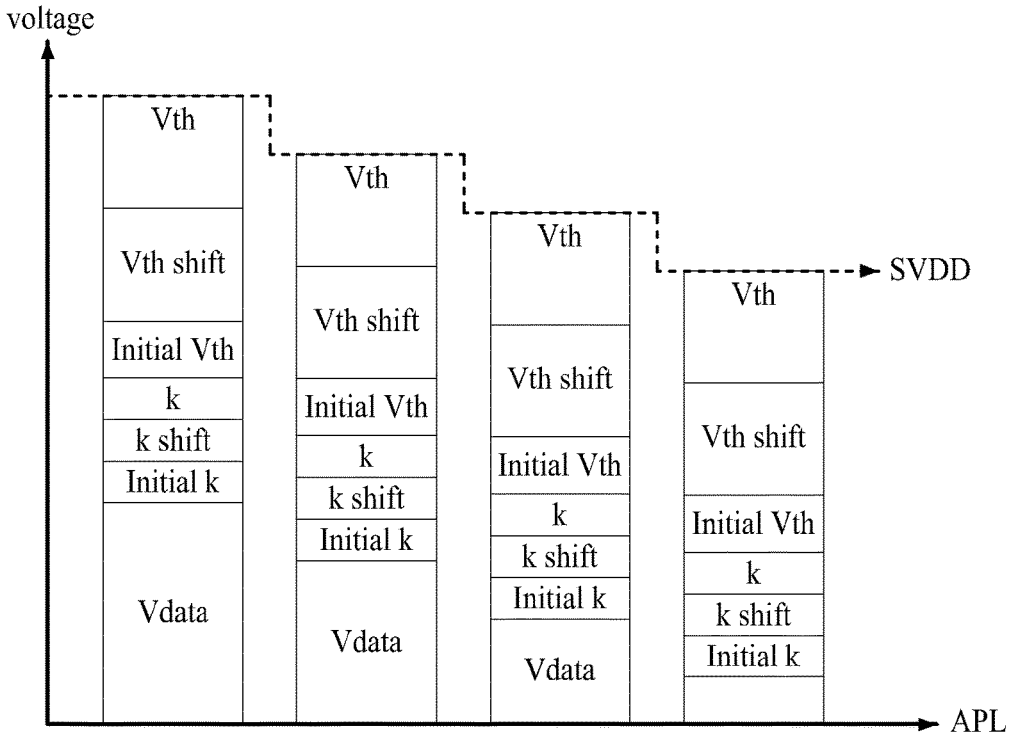
FIG. 3 Related Art

Reference will now be made in detail to the exemplary embodiments of the present invention, examples of which are illustrated in the accompanying drawings. Wherever possible, the same reference numbers will be used throughout the drawings to refer to the same or like parts.

In the specification, in adding reference numerals for elements in each drawing, it should be noted that like reference numerals already used to denote like elements in other drawings are used for elements wherever possible.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

The present invention relates to an organic light emitting display device based on an external compensation scheme and a method of driving the same. The organic light emitting display device and the method of driving the same according to the present invention optimizes an SVDD voltage supplied to a data driver according to a compensation voltage at a current timing. Therefore, the present invention can decrease consumption power that is wasted without being actually used in a driving voltage (SVDD) of the data driver. Hereinafter, an organic light emitting display device and a pixel structure thereof will be described, and then, the organic light emitting display device and the method of driving the same according to embodiments of the present invention will be described.

Figure 4:
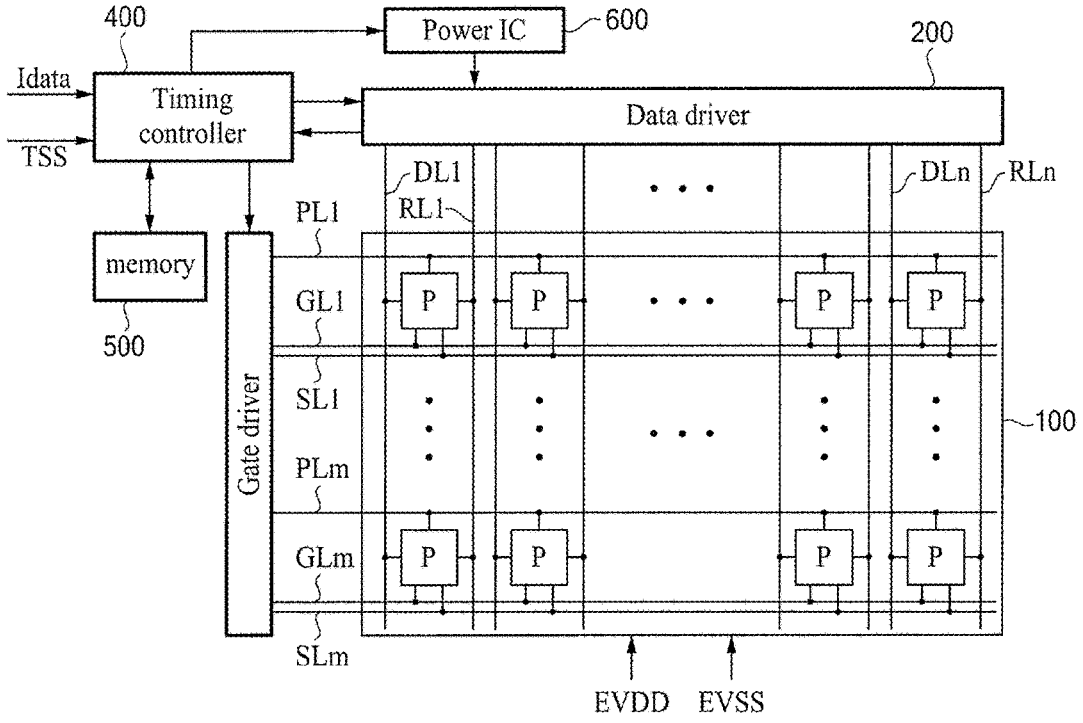
FIG. 4 is a diagram schematically illustrating an organic light emitting display device according to an embodiment of the present invention.
Figure 5:
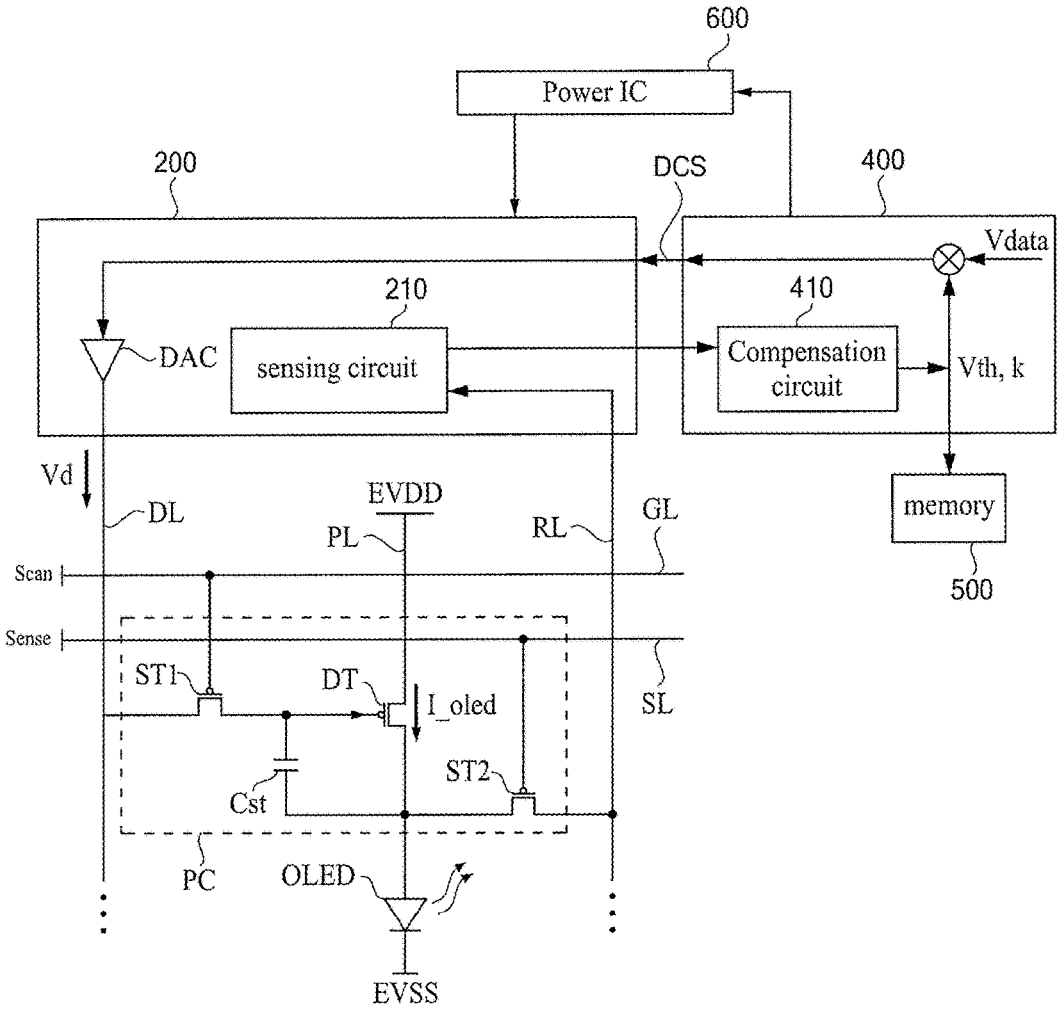
FIG. 5 is a circuit diagram for describing a data driver and pixel structure of the organic light emitting display device according to an embodiment of the present invention.

FIG. 4 is a diagram schematically illustrating an organic light emitting display device according to an embodiment of the present invention, and FIG. 5 is a circuit diagram for describing a data driver and pixel structure of the organic light emitting display device according to an embodiment of the present invention.

Referring to FIGS. 4 and 5, the organic light emitting display device according to an embodiment of the present invention includes a display panel 100 and a driving circuit unit. The driving circuit unit includes a data driver 200, a gate driver 300, a timing controller 400, a memory 500, and a power unit 600.

The display panel 100 includes a plurality of gate lines GL, a plurality of sensing signal lines SL, a plurality of data lines DL, a plurality of driving power lines PL, a plurality of reference power lines RL, and a plurality of pixels P.

A difference voltage "Vdata-Vref" between a driving voltage "Vd=Vdata+Vth, k" and a reference voltage Vref is charged into a capacitor Cst connected between a gate and drain of a driving TFT DT. The driving TFT DT is turned on with a voltage charged into the capacitor Cst. The organic light emitting diode OLED emits light with a data current Ioled which flows from a first driving voltage EVDD terminal to a second driving voltage EVSS terminal through the driving TFT DT.

Each of the pixels P may include one of a red pixel, a green pixel, a blue pixel, and a white pixel. One unit pixel for displaying one image may include adjacent red pixel, green pixel, and blue pixel. As another example, the unit pixel may include adjacent red pixel, green pixel, blue pixel, and white pixel.

Each of the plurality of pixels P is formed in a pixel area defined in the display panel 100. To this end, the plurality of gate lines GL, the plurality of sensing signal lines SL, the plurality of data lines DL, the plurality of driving power lines PL, and the plurality of reference power lines RL are formed in the display panel 100 in order to define the pixel area.

The plurality of gate lines GL and the plurality of sensing signal lines SL may be parallelly formed in a first direction (for example, a horizontal direction) in the display panel 100. A scan signal (gate driving signal) is applied from the gate driver 300 to the gate lines GL. A sensing signal is applied from the gate driver 300 to the sensing signal lines SL.

The plurality of data lines DL may be formed in a second direction (for example, a vertical direction) in the display panel 100. The plurality of data lines DL may be formed to intersect the plurality of gate lines GL and the plurality of sensing signal lines SL.

A driving voltage Vd is supplied from the data driver 200 to a data line DL. Here, the driving voltage Vd is a voltage that is obtained by summating a compensation voltage (a threshold voltage "Vth"), used to compensate for a characteristic change of the driving TFT, and a data voltage Vdata based on an image signal. That is, the driving voltage Vd has a voltage level that is obtained by adding a compensation voltage, corresponding to a characteristic (the threshold voltage "Vth" and mobility "k") of the driving TFT of a corresponding pixel P, to the data voltage Vdata.

The characteristic compensation of the driving TFT may be selectively performed by using the compensation voltage at a turn-on time when the organic light emitting display device is turned on, a driving period in which an image is displayed, or a turn-off time when the organic light emitting display device is turned off.

The plurality of reference power lines RL are formed in parallel to the plurality of data lines DL. A display reference voltage Vpre_r or a sensing precharging voltage Vpre_s may be selectively supplied to the reference power lines RL by the data driver 200. In this case, the display reference voltage Vpre_r may be supplied to each of the reference power lines RL during a data charging period of a corresponding pixel P. The sensing precharging voltage Vpre_s may be supplied to each reference power line RL during a detection period in which the threshold voltage and mobility of the driving TFT DT of a corresponding pixel P are detected.

The plurality of driving power lines PL may be formed in parallel with the gate lines GL, and the first driving voltage EVDD is supplied to the pixels P through the respective driving power lines PL.

As illustrated in FIG. 5, the capacitor Cst of each pixel P is charged with a difference voltage between the driving voltage Vd and the reference voltage Vref during a data charging period. Each pixel P includes a pixel circuit PC that supplies the data current Ioled to the organic light emitting diode OLED according to a voltage charged into the capacitor Cst during an emission period.

The pixel circuit PC includes a first switching TFT ST1, a second switching TFT ST2, the driving TFT DT, and the capacitor Cst. Here, the TFTs ST1, ST2 and DT are P-type TFTs, and for example, may be an a-Si TFT, a poly-Si TFT, an oxide TFT, or an organic TFT. However, the present invention is not limited thereto, and the TFTs ST1, ST2 and DT may be formed as N-type TFTs.

The first switching TFT ST1 has a gate connected to a corresponding gate line GL, a source (first electrode) connected to a data line DL, and a drain (second electrode) connected to a first node n1 connected to a gate of the driving TFT DT.

The first switching TFT ST1 is turned on according to a gate-on voltage level of scan signal supplied to the gate line GL. When the first switching TFT ST1 is turned on, the driving voltage Vd supplied from the data driver 200 to a corresponding data line DL is supplied to the first node n1, namely, a gate of the driving TFT DT.

The second switching TFT ST2 has a gate connected to a corresponding sensing signal line SL, a source (first electrode) connected to a second node n2 connected to the driving TFT DT and the organic light emitting diode OLED, and a drain (second electrode) connected to a corresponding reference power line RL.

The second switching TFT ST2 is turned on according to a gate-on voltage level of sensing signal supplied to the sensing signal line SL. When the second switching TFT ST2 is turned on, the display reference voltage Vpre_r or sensing precharging voltage Vpre_s supplied to the reference power line RL is supplied to the second node n2.

The capacitor Cst is connected between a gate and source of the driving TFT DT, namely, between the first node n1 and the second node n2. The capacitor Cst is charged with a difference voltage between voltages respectively supplied to the first and second nodes n1 and n2.

The gate of the driving TFT DT is connected to the drain of the first switching TFT ST1 and a first electrode of the capacitor Cst in common. The source of the driving TFT DT is connected to a corresponding driving power line PL. A drain of the driving TFT DT is connected to the drain of the second switching TFT ST2, a second electrode of the capacitor Cst, and an anode of the organic light emitting diode OLED. The driving TFT DT is turned on with the driving voltage Vd supplied thereto, and controls an amount of current flowing to the organic light emitting diode OLED according to the first driving voltage EVDD.

The organic light emitting diode OLED emits light with the data current Ioled supplied from the driving TFT DT of the pixel circuit PC, thereby emitting single color light having a luminance corresponding to the data current Ioled.

To this end, the organic light emitting diode OLED includes the anode connected to the second node n2 of the pixel circuit PC, an organic layer (not shown) formed on the anode, and a cathode (not shown) that is formed on the organic layer and receives the second driving voltage EVSS.

The timing controller 400 according to an embodiment of the present invention controls operations of the data driver 200 and the gate driver 300. For example, the timing controller 400 operates the data driver 200 and the gate driver 300 in a driving mode, thereby allowing an image to be displayed. Also, the timing controller 400 operates the data driver 200 and the gate driver 300 in a sensing mode, thereby allowing a characteristic change of the driving TFT (formed in each pixel) to be sensed.

In FIG. 5, the data driver 200 and the timing controller 400 are provided as separate elements, but may be integrated into one integration circuit (IC) chip without being limited thereto.

The timing controller 400 generates a gate control signal GCS and a data control signal DCS by using a timing sync signal TSS. Here, the timing sync signal TSS may include a vertical sync signal Vsync, a horizontal sync signal Hsync, a data enable signal DE, and a clock DCLK.

The gate control signal GCS for controlling the gate driver 300 may include a gate start signal and a plurality of clock signals. The data control signal DCS for controlling the data driver 200 may include a data start signal, a data shift signal, and a data output signal.

The timing controller 400 selectively operates the data driver 200 and the gate driver 300 in the sensing mode at a turn-on time when the organic light emitting display device is turned on, a driving time when an image is displayed, or a turn-off time when the organic light emitting display device is turned off.

Furthermore, the timing controller 400 may operate the data driver 200 and the gate driver 300 in the sensing mode at the turn-on time, the driving time, and the turn-off time.

For example, a sensing driving operation at the turn-on time is performed for about two seconds before power is supplied and an image starts to be displayed. At the turn-on time, the characteristic changes of the driving TFTs of all the pixels of the display panel 100 are sensed.

As another example, a sensing driving operation at the driving time sequentially senses, in real time, all horizontal lines by one horizontal line during a blank interval between an nth frame and an n+1st frame when a driving operation is being performed.

As another example, a sensing driving operation at the turn-off time may be performed for 30 to 60 seconds after the organic light emitting display device is turned off An image displaying operation, a real-time sensing operation, and a real-time compensation operation are ended at the turn-off time. However, main power of a system is maintained as-is, and the characteristic changes of the driving TFTs of all the pixels of the display panel 100 are precisely sensed for 30 to 60 seconds. In this case, since an image is not displayed on a screen of the display panel 100, a viewer cannot perceive the characteristic changes of the driving TFTs of all the pixels being precisely sensed.

A sensing circuit 210 built into the data driver 200 senses the characteristic changes of the driving TFTs of all the pixels. Subsequently, a compensation circuit 410 built into the timing controller 400 generates the compensation voltage. In this case, the compensation circuit 410 may generate the compensation voltage on the basis of sensing data in which the characteristic changes of the driving TFTs of all the pixels are reflected.

The gate driver 300 operates in the driving mode and the sensing mode according to a mode control of the timing controller 400. The gate driver 300 is connected to the plurality of gate lines GL and the plurality of sensing signal lines SL.

The gate driver 300 generate a gate-on voltage level of scan signal at every one horizontal period according to the gate control signal GCS supplied from the timing controller 400, in the driving mode. The gate driver 300 sequentially supplies the scan signal to the plurality of gate lines GL.

The scan signal has the gate-on voltage level during the data charging period of each pixel P. Also, the scan signal has a gate-off voltage level during the emission period of each pixel P. The gate driver 300 may include a shift register that sequentially outputs the scan signal.

The gate driver 300 generate a gate-on voltage level of sensing signal at every initialization period and sensing voltage charging period of each pixel P, in the sensing mode. The gate driver 300 sequentially supplies the scan signal to the plurality of sensing signal lines SL.

The gate driver 300 may be provided in an IC type, or may be directly provided on a substrate of the display panel 100 at the same time with a process of forming the transistors of each pixel P.

Moreover, the gate driver 300 may be connected to the plurality of driving power lines PL1 to PLm, and may supply the driving voltage EVDD, supplied from an external power supply (not shown), to the plurality of driving power lines PL1 to PLm.

Subsequently, the data driver 200 is connected to the plurality of data lines D1 to Dn, and operates in the display mode and the sensing mode according to a mode control of the timing controller 400.

The driving mode for displaying an image may include the data charging period, in which each pixel is charged with a data voltage, and the emission period in which the organic light emitting diode OLED emits light. The sensing mode may include the initialization period for initializing each pixel, the sensing voltage charging period, and the sensing period.

The data driver 200 converts the pixel data DATA, input thereto, into data voltages Vdata, and respectively supplies the data voltages to the data lines DL. To this end, the data driver 200 may include a shift register, a latch, a grayscale voltage generator, a digital-analog converter (DAC), and an output unit.

The shift register generates a sampling signal, and the latch latches the pixel data DATA according to the sampling signal. The grayscale voltage generator generates a plurality of grayscale voltages by using a plurality of reference gamma voltages, and the DAC selects and outputs, as the data voltage Vdata, a grayscale voltage corresponding to the latched pixel data DATA among the plurality of grayscale voltages. The output unit outputs the data voltage Vdata.

The data driver 200 supplies the driving voltage Vd, which is obtained by summating the compensation voltage "Vth, k" and the data voltage Vdata based on an image signal. In this case, the driving voltage Vd has a voltage level that is obtained by adding a compensation voltage, corresponding to a characteristic (the threshold voltage/mobility) of the driving TFT DT of a corresponding pixel P, to the data voltage Vdata.

Referring again to FIG. 4, the timing controller 400 controls the power unit 600 to optimize the driving voltage SVDD supplied to the data driver 200, according to the characteristic change of the driving TFT of each pixel which is sensed by the sensing circuit 210 built into the data driver 200.

For example, the timing controller 400 controls the power unit 600 to set the driving voltage SVDD supplied to the data driver 200, based on a sequential compensation voltage which is currently generated by the compensation circuit 410 built into the timing controller 400.

Here, the compensation circuit 410 built into the timing controller 400 generates a compensation voltage, and reflects the compensation voltage in a data voltage based on an image signal. The compensation voltage generated by the compensation circuit 410 includes an initial compensation voltage of the driving TFT and a sequential compensation voltage based on a time that elapses in driving of the driving TFT.

Figure 6:
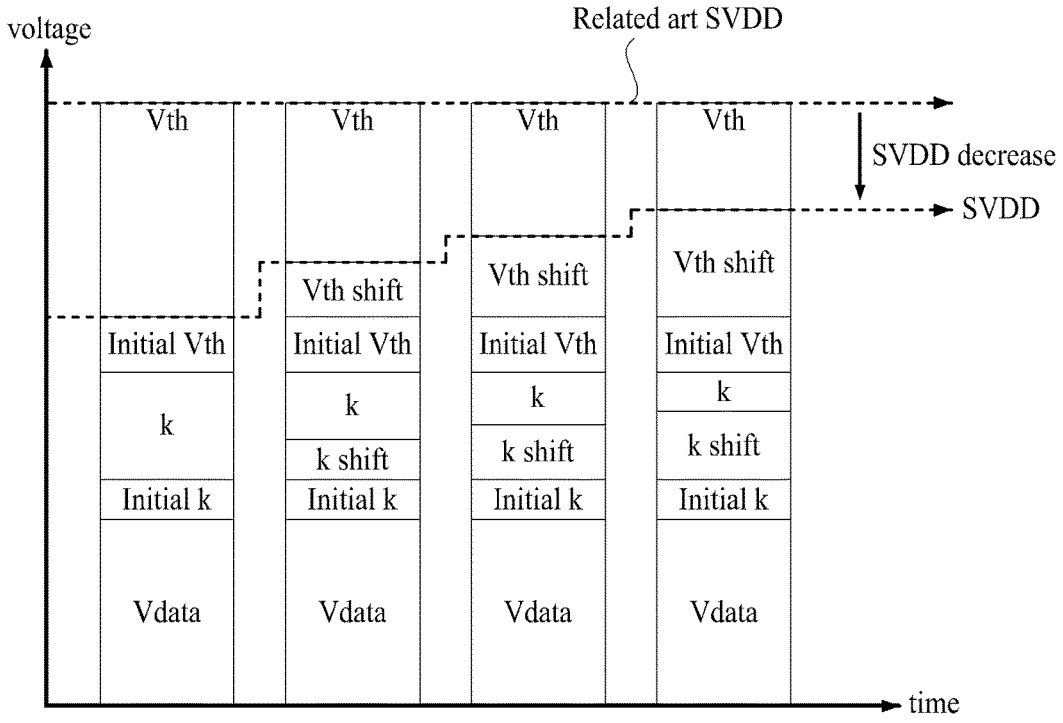
FIGS. 6 and 7 are diagrams illustrating an SVDD voltage setting method based on an internal compensation scheme according to an embodiment of the present invention.
Figure 7:
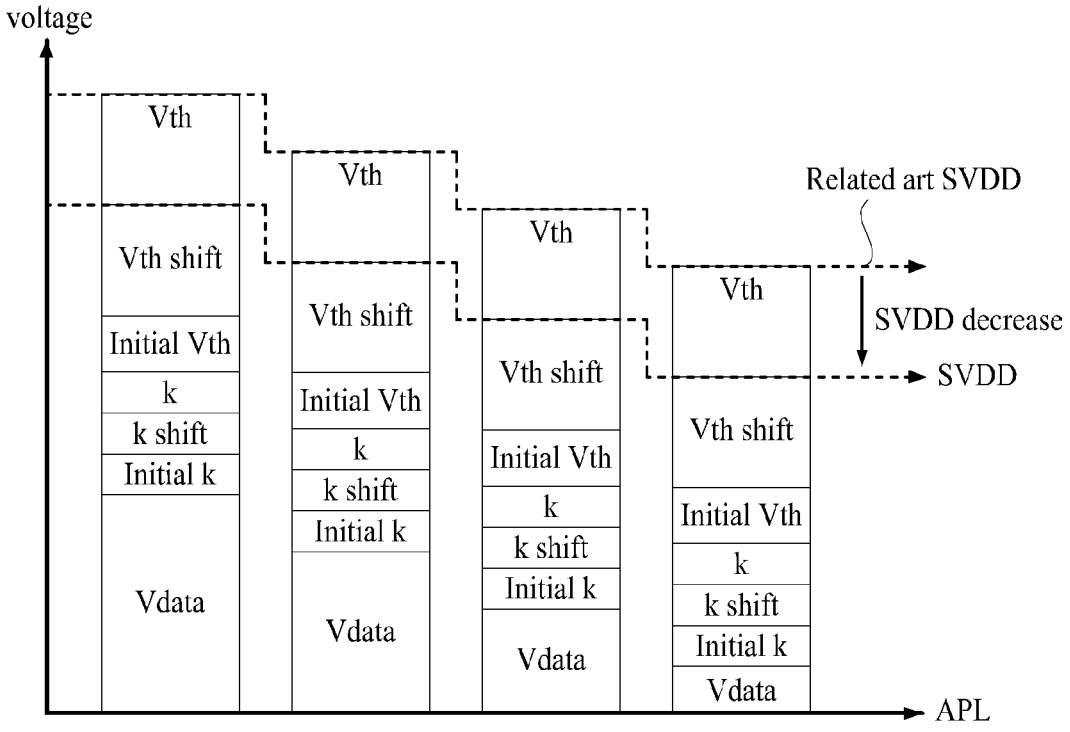

FIGS. 6 and 7 are diagrams illustrating an SVDD voltage setting method based on an internal compensation scheme according to an embodiment of the present invention.

Referring to FIGS. 6 and 7, the compensation voltage is composed of the sum of the initial compensation voltage and the sequential compensation voltage.

The initial compensation voltage is used to compensate for a characteristic deviation (which occurs in a manufacturing process) between all the driving TFTs, and is a voltage for compensating the initial threshold voltage "Vth" and the mobility "k".

The initial compensation voltage is generated by loading initial compensation data stored in the memory 500. The display panel is finished, and then, the initial compensation data is stored in the memory 500 before a product is released. The initial compensation data is stored in the memory 500 so as to compensate for the characteristics of the driving TFTs of all the pixels, based on sensing data which are generated by sensing the driving TFTs of all the pixels before the product is released. The characteristics of the driving TFTs of all the pixels may be initialized by loading the initial compensation data stored in the memory 500.

Here, the compensation data may be updated by reflecting the sensing data (which is generated by the sensing driving operation) in the initial compensation data stored in the memory 500, and the updated compensation data may be stored in the memory 500.

The sequential compensation voltage is used to compensate for the deterioration or characteristic change of the driving TFT which occurs when the organic light emitting display device is driven. That is, the sequential compensation voltage is used to compensate for the sequential change of the characteristic of the driving TFT, and is a voltage for compensating for the sequential threshold voltage "Vth" and the sequential mobility "k".

The SVDD value that is the driving voltage of the data driver is determined by the driving voltage supplied to each of all the pixels. The SVDD value of the data driver is set to cover the maximum driving voltage supplied to each pixel.

The organic light emitting display device according to an embodiment of the present invention uses the external compensation scheme. Therefore, the data driver supplies the driving voltage, which is obtained by summating the compensation voltage and the data voltage based on an image signal, to each pixel. Accordingly, in the external compensation scheme, the compensation voltage is determined by reflecting the characteristic change of the driving TFT of each pixel even when the same data voltage is input, and thus, the driving voltage of each pixel is changed.

The present invention optimizes the SVDD voltage supplied to the data driver according to a current compensation voltage. Accordingly, the present invention can decrease consumption power that is wasted without being actually used in the driving voltage (SVDD) of the data driver.

In detail, the initial compensation voltage may be checked by using the initial compensation data stored in the memory 500. A sequential compensation voltage which requires compensation at a current time may be known by performing a real-time sensing operation. Therefore, as a driving time of the driving TFT of each pixel elapses, a current compensation voltage is calculated. The driving voltage of each pixel may be known by summating a compensation voltage and a data voltage based on a current image signal.

The timing controller 400 calculates the maximum driving voltage on the basis of the driving voltages of all the pixels, and controls the power unit 600 to set the SVDD value, which is the driving voltage of the data driver, according to the maximum driving voltage.

The initial compensation voltage is not changed, but the threshold voltage "Vth" and the mobility "k" are changed due to driving of the organic light emitting display device. Therefore, the sequential compensation voltage based on an elapse of the driving time of the driving TFT may be reflected for optimizing the SVDD value that is the driving voltage of the data driver.

When the organic light emitting display device is initially driven, a driving voltage corresponding to the sum of an initial compensation voltage and a data voltage based on an image signal is supplied to each pixel. That is, a sequential compensation voltage based on a sequential change is not used at an initial driving time of the organic light emitting display device.

Therefore, the driving voltage composed of the sum of the initial compensation voltage and the data voltage based on the image signal is supplied to each pixel by the data driver at the initial driving time of the organic light emitting display device. As described above, since the SVDD value that is the driving voltage of the data driver is set as a value corresponding to the sum of the initial compensation voltage and the data voltage, unnecessary power consumption can be reduced.

Subsequently, the organic light emitting display device is driven for a certain time, and then, the characteristic of the driving TFT of each pixel is sequentially changed. In this case, a compensation voltage is set to a value corresponding to the sum of the initial compensation voltage and the sequential compensation voltage. A driving voltage, corresponding to the sum of the initial compensation voltage, the sequential compensation voltage, and a data voltage based on an image signal, is supplied to each pixel, and thus, the SVDD value that is the driving voltage of the data driver is set as a value corresponding to the driving voltage supplied to each pixel.

Even when the compensation voltage includes the initial compensation voltage and the sequential compensation voltage, the SVDD value that is the driving voltage of the data driver is set based on a sequential compensation voltage at a current time, thereby reducing unnecessary power consumption. Here, the sequential compensation voltage is generated by reflecting a sequential change of the mobility "k" in addition to the threshold voltage "Vth".

The initial compensation voltage and the data voltage based on the image signal are not changed in proportion to the driving time of the organic light emitting display device. However, the sequential compensation voltage increases in proportion to the driving time of the organic light emitting display device. Therefore, the SVDD value that is the driving voltage of the data driver increases in proportion to the driving time of the organic light emitting display device. That is, as the driving time of the organic light emitting display device increases, the SVDD value that is the driving voltage of the data driver is set as a high value.

Each of the initial compensation voltage and the data voltage based on the image signal has a fixed value. As a result, the SVDD value that is the driving voltage of the data driver is set based on a sequential compensation voltage which is currently generated based on sensing data of each pixel which is sensed in real time.

In the related art, the SVDD voltage is changed according to an APL of the data voltage Vdata. For this reason, as the APL becomes higher, a ratio of an unused compensation voltage in a total SVDD voltage increases.

On the other hand, as illustrated in FIG. 7, the SVDD value may be set based on an APL. In this case, a compensation voltage has a voltage value corresponding to an initial threshold value "Vth", an initial mobility "k", a sequential change value "Vth shift" of a threshold voltage "Vth", and a sequential change value "k shift" of mobility. In addition, the SVDD value that is the driving voltage of the data driver is set as a voltage value corresponding to the sum of the compensation voltage and a data voltage Vdata based on an image signal. As described above, the SVDD value that is the driving voltage of the data driver is optimized based on the initial compensation voltage and the sequential compensation voltage, thereby reducing unnecessary power consumption.

Figure 8:
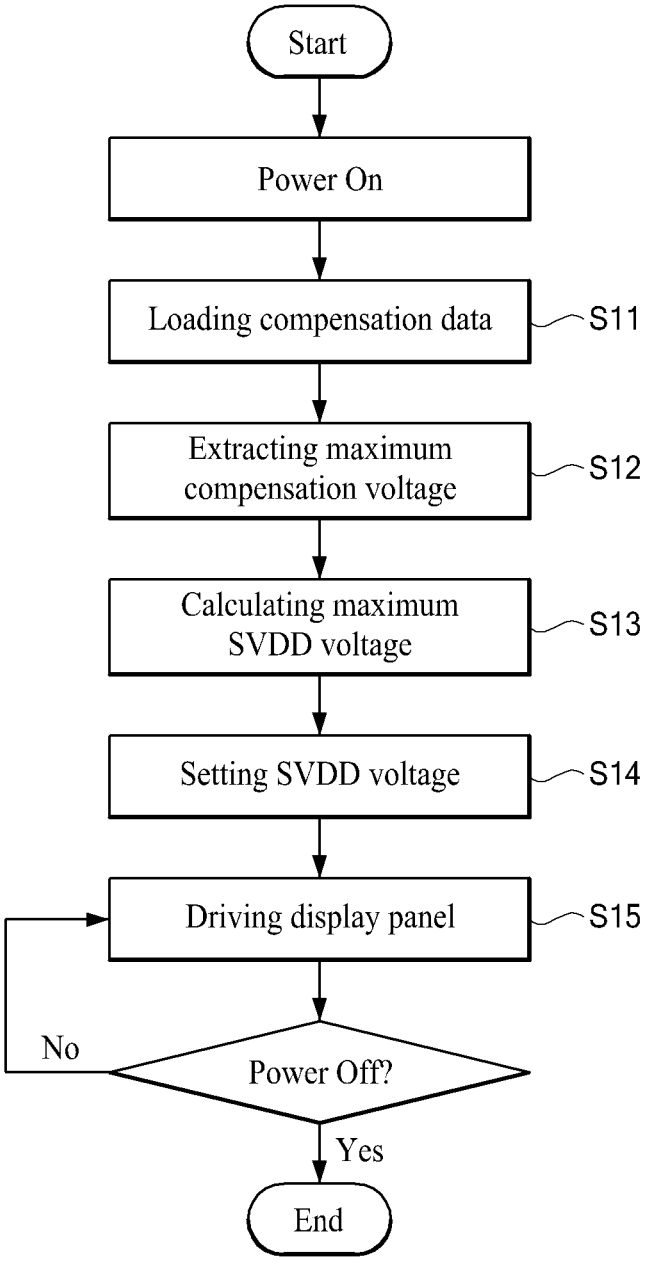
FIG. 8 is a diagram illustrating a method of driving an organic light emitting display device according to a first embodiment of the present invention.

FIG. 8 is a diagram illustrating a method of driving an organic light emitting display device according to a first embodiment of the present invention.

Referring to FIG. 8, when the organic light emitting display device is turned on, an initial compensation voltage of each of all the pixels is generated by loading initial compensation data stored in the memory 500, in operation S11. Also, a sequential compensation voltage of each of all the pixels is generated based on real-time sensing.

Subsequently, the organic light emitting display device summates the initial compensation voltage and the sequential compensation voltage to generate a compensation voltage of each of all the pixels, and extracts the maximum compensation voltage on the basis of the compensation voltage of each pixel, in operation S12.

Subsequently, the organic light emitting display device calculates the SVDD value, which is the driving voltage of the data driver 200, as the minimum value corresponding to the sum of the maximum compensation voltage and a data voltage based on an image signal, in operation S13.

Subsequently, the timing controller 400 controls the power unit 600 to set the calculated SVDD value, and supplies the set SVDD value to the data driver 200, in operation S14.

Subsequently, in operation S15, the data driver 200 is driven according to the set SVDD value, and supplies a driving voltage, composed of the sum of the data voltage based on the image signal and a compensation voltage, to each pixel to drive the display panel, thereby displaying an image.

The method of driving an organic light emitting display device according to the first embodiment of the present invention illustrated in FIG. 8 may set the optimized SVDD value each time the organic light emitting display device is turned on. Accordingly, unnecessary power consumption can be reduced.

Figure 9:
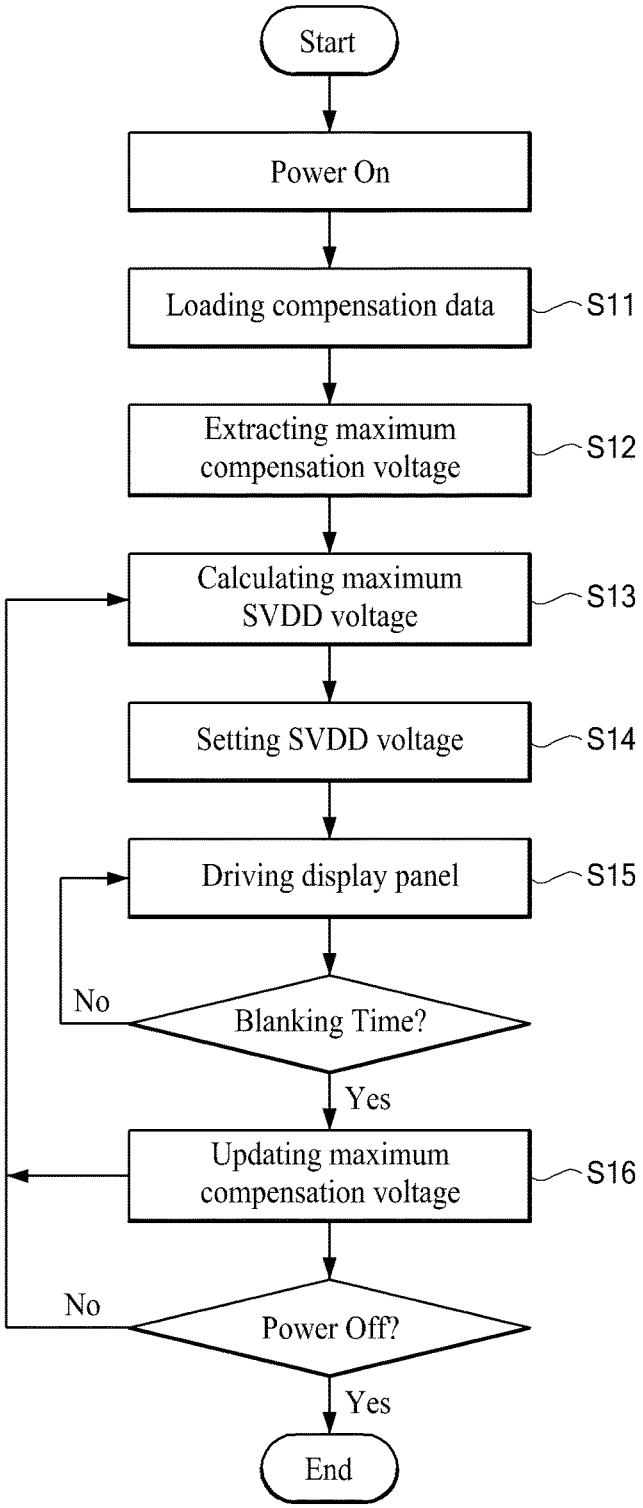
FIG. 9 is a diagram illustrating a method of driving an organic light emitting display device according to a second embodiment of the present invention.

FIG. 9 is a diagram illustrating a method of driving an organic light emitting display device according to a second embodiment of the present invention.

Referring to FIG. 9, when the organic light emitting display device is turned on, an initial compensation voltage of each of all the pixels is generated by loading initial compensation data stored in the memory 500, in operation S11. Also, a sequential compensation voltage of each of all the pixels is generated based on real-time sensing.

Subsequently, the organic light emitting display device summates the initial compensation voltage and the sequential compensation voltage to generate a compensation voltage of each of all the pixels, and extracts the maximum compensation voltage on the basis of the compensation voltage of each pixel, in operation S12.

Subsequently, the organic light emitting display device calculates the SVDD value, which is the driving voltage of the data driver 200, as the minimum value corresponding to the sum of the maximum compensation voltage and a data voltage based on an image signal, in operation S13.

Subsequently, the timing controller 400 controls the power unit 600 to set the calculated SVDD value, and supplies the set SVDD value to the data driver 200, in operation S14.

Subsequently, in operation S15, the data driver 200 is driven according to the set SVDD value, and supplies a driving voltage, composed of the sum of the data voltage based on the image signal and a compensation voltage, to each pixel to drive the display panel, thereby displaying an image.

Subsequently, in operation S16, the organic light emitting display device calculates the maximum compensation voltage on the basis of the sequential compensation voltage of each pixel based on real-time sensing at a blanking time. Subsequently, the organic light emitting display device updates the maximum compensation voltage to the calculated maximum compensation voltage. Subsequently, the organic light emitting display device performs operations subsequent to operation S13 to set a new SVDD voltage, and drives the display panel to display an image.

As another example, in operation S16, the organic light emitting display device may calculate the maximum compensation voltage on the basis of the sequential compensation voltage of each pixel based on real-time sensing at every certain time in addition to the blanking time. Subsequently, the organic light emitting display device updates the maximum compensation voltage to the calculated maximum compensation voltage. Subsequently, the organic light emitting display device performs operations subsequent to operation S13 to set a new SVDD voltage, and drives the display panel to display an image.

The method of driving an organic light emitting display device according to the second embodiment of the present invention illustrated in FIG. 9 may set the optimized SVDD value each time the organic light emitting display device is turned on. Also, even during the driving period in which an image is displayed, the organic light emitting display device may set the optimized SVDD value at a blanking time between frames and/or at every certain period The SVDD value that is the driving voltage of the data driver is set as a value, corresponding to a driving voltage composed of an initial compensation voltage and a data voltage based on an image signal, at an initial driving time of the organic light emitting display device. Accordingly, unnecessary power consumption can be reduced.

In the organic light emitting display device and the method of driving the same according to the embodiments of the present invention, the SVDD value that is the driving voltage of the data driver is optimized based on a data voltage, an initial compensation voltage, and a sequential compensation voltage with time in driving. Accordingly, unnecessary power consumption can be reduced.

The organic light emitting display device and the method of driving the same according to the embodiments of the present invention can reduce the driving voltage of the data driver.

The organic light emitting display device and the method of driving the same according to the embodiments of the present invention can decrease consumption power that is wasted without being actually used in the driving voltage (SVDD) of the data driver.

According to the present invention, the SVDD value that is the driving voltage of the data driver is set as a value, corresponding to a driving voltage composed of an initial compensation voltage and a data voltage based on an image signal, at an initial driving time of the organic light emitting display device, thereby reducing unnecessary power consumption.

In the organic light emitting display device and the method of driving the same according to the embodiments of the present invention, the SVDD value that is the driving voltage of the data driver is optimized based on a data voltage, an initial compensation voltage, and a sequential compensation voltage with time in driving, thereby reducing unnecessary power consumption.

The organic light emitting display device and the method of driving the same according to the embodiments of the present invention can increase an accuracy and stability of compensation for the threshold voltage shift of the driving TFT.

The organic light emitting display device and the method of driving the same according to the embodiments of the present invention can decrease a real-time compensation error of characteristic (a threshold voltage/mobility) compensation of the driving TFT.

The organic light emitting display device and the method of driving the same according to the embodiments of the present invention increases a uniformity of all the pixels, thereby enhancing a quality of an image.

The organic light emitting display device and the method of driving the same according to the embodiments of the present invention increases an accuracy of characteristic (the threshold voltage/mobility) compensation of the driving TFT, thereby extending a service life of the organic light emitting display device.

In addition to the aforesaid features and effects of the present invention, other features and effects of the present invention can be newly construed from the embodiments of the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel configured to include a plurality of pixels, each of the plurality of pixels including an organic light emitting diode (OLED) and a pixel circuit for emitting light from the corresponding OLED;

a compensation circuit configured to generate a compensation voltage composed of an initial compensation voltage to compensate for an initial threshold voltage and a mobility of a driving thin film transistor (TFT) and a sequential compensation voltage to compensate for a sequential change of the initial threshold voltage and the mobility of the driving TFT based on an elapse of a driving time of the driving TFT;

a data driver configured to reflect the compensation voltage in a data voltage based on an image signal to generate a pixel driving voltage including the compensation voltage and the data voltage that is used to drive the driving TFT included in the pixel circuit, and supply the pixel driving voltage of the driving TFT to each of the plurality of pixels;

a power unit connected to the data driver; and a timing controller configured to set a driving voltage of the data driver corresponding to a sum of the data voltage based on the image signal and the compensation voltage including the initial compensation voltage and the sequential compensation voltage at a current time, and to control the power unit to supply the set driving voltage to the data driver, wherein the initial compensation voltage has a fixed value generated by loading initial compensation data stored in a memory, and the sequential compensation voltage has a variable value determined by performing a real-time sensing operation for optimizing the driving voltage of the data driver based on the elapse of the driving time of the driving TFT, wherein the driving voltage of the data driver is a variable voltage supplied to the data driver, wherein the driving voltage of the data driver is set as a sum of the data voltage and a maximum compensation voltage, and wherein the maximum compensation voltage is a maximum value of a plurality of values obtained by summating the sequential compensation voltage and the initial compensation voltage of each of all pixels.

2. The organic light emitting display device of claim 1, wherein the compensation circuit is built into the data driver.

3. The organic light emitting display device of claim 1, wherein at an initial driving time, the driving voltage of the data driver is set as a value corresponding to a sum of the data voltage based on the image signal and the initial compensation voltage.

4. The organic light emitting display device of claim 1, wherein the driving voltage of the data driver is set based on the data voltage, the initial compensation voltage, and the sequential compensation voltage depending on an elapse of the driving time.

5. The organic light emitting display device of claim 1, wherein the driving voltage of the data driver is set as a high value in proportion to the driving time.

6. A method of driving an organic light emitting display device including a data driver, a power unit connected to the data driver, and a timing controller, the method comprising:

generating an initial compensation voltage to compensate for an initial threshold voltage and a mobility of a driving thin film transistor (TFT) of a pixel of the display device;

generating a sequential compensation voltage of each pixel to compensate for a sequential change of the initial threshold voltage and the mobility of the driving TFT based on an elapse of a driving time of the driving TFT, wherein a driving voltage of the data driver for generating a pixel driving voltage is a sum of a data voltage based on an image signal, the initial compensation voltage, and the sequential compensation voltage, wherein the initial compensation voltage has a fixed value generated by loading initial compensation data stored in a memory, and the sequential compensation voltage has a variable value determined by performing a real-time sensing operation for optimizing the driving voltage of the data driver based on the elapse of the driving time of the driving TFT;

extracting a compensation voltage including the initial compensation voltage and the sequential compensation voltage of each of all pixels of the device at a current time to calculate a maximum compensation voltage; and setting the driving voltage of the data driver, based on a sum of the data voltage based on the image signal and the maximum compensation voltage, wherein the driving voltage of the data driver is a variable voltage supplied to the data driver, and wherein the maximum compensation voltage is a maximum value of a plurality of values obtained by summating the sequential compensation voltage and the initial compensation voltage of each of the all pixels.

7. The method of claim 6, wherein the calculating of the maximum compensation voltage comprises:

sensing a characteristic change of the driving TFT of each of the all pixels at a current time to generate a sequential compensation voltage of each of the all pixels at the current time.

8. The method of claim 6, further comprising setting the driving voltage of the data driver each time the organic light emitting display device is turned on.

9. The method of claim 6, further comprising setting the driving voltage of the data driver as a value corresponding to a sum of the data voltage based on the image signal and the initial compensation voltage, at an initial driving time.

10. The method of claim 6, further comprising setting the driving voltage of the data driver based on the data voltage, the initial compensation voltage, and the sequential compensation voltage depending on an elapse of the driving time.

* * * * *